United States Patent [19]

Nakauchi et al.

[11] 4,053,939

[45] Oct. 11, 1977

[54] ELECTRIC LOCK SYSTEM

[75] Inventors: Shunsaku Nakauchi, Mitaka; Akifusa Takahashi, Tokyo, both of Japan

[73] Assignee: Kokusai Gijutsu Kaihatsu Kabushiki Kaisha, Tokyo, Japan

[21] Appl. No.: 634,388

[22] Filed: Nov. 24, 1975

[30] Foreign Application Priority Data

Nov. 25, 1974 Japan ..... 49-134375
Nov. 25, 1974 Japan ..... 49-134376

[51] Int. Cl.[2] ..... H01H 47/00
[52] U.S. Cl. ..... 361/171; 292/144
[58] Field of Search ..... 317/134, 150, 154, DIG. 4, 317/DIG. 6; 70/278-280; 340/157, 158, 164 A, 167 P; 292/144; 361/171

[56] References Cited

U.S. PATENT DOCUMENTS

| | | | |
|---|---|---|---|
| 2,096,935 | 10/1937 | Hitchcock | 317/150 X |
| 2,321,922 | 6/1943 | Leathers | 340/160 X |
| 3,521,921 | 7/1970 | Miyazaki | 292/144 |
| 3,837,192 | 9/1974 | Arouete | 292/144 X |

FOREIGN PATENT DOCUMENTS

| | | | |
|---|---|---|---|
| 401,069 | 8/1924 | Germany | 70/279 |

*Primary Examiner*—Harry E. Moose, Jr.
*Attorney, Agent, or Firm*—Sughrue, Rothwell, Mion, Zinn and Macpeak

[57] ABSTRACT

An electric lock system is disclosed comprising an electro-mechanical lock device including a pair of current terminals and a self-sustaining solenoid circuit, a control device including a pair of current terminals, at least one d.c. current source and means for changing the direction of the d.c. current. The electro-mechanical lock device is put in a locking condition and an unlocking condition according to the application of the d.c. current supplied thereto from the control device through the lead wires and these conditions are detected in the control device via the same lead wires.

6 Claims, 9 Drawing Figures

ELECTRIC LOCK SYSTEM

BACKGROUND OF THE INVENTION

The present invention relates to an electric lock system and, particularly, to an electric lock system in which the locking operation is controlled and monitored by an electric signal.

In the past, in order to control an electric lock device, a detector which operates upon conditions such as the opening and closing of a door and locking and unlocking of the lock device is provided for each lock device. The detector is usually connected to a control panel installed remotely therefrom through a plurality of lead wires and, in addition, a plurality of lead wires are required to supply electric power for driving a solenoid of the electric lock device. Therefore, the total number of lead wires required for each lock device is relatively large.

For example, an electric lock system disclosed in Japanese utility model publication No. 6877/1966 requires three lead wires between a lock device and an indicator. Another electric lock system, disclosed in Japanese Patent Publication Nos. 21184/1967 and 21186/1967, also requires three lead wires. Further, a lock system disclosed in Japanese Utility Model Disclosure No. 12294/1973 requires five lead wires between the lock device and control panel.

In a situation where such a control panel or control device is required, it is usual that a large number of lock devices are monitored and controlled thereby. Therefore, the total number of lead wires becomes very large resulting in many economical and technical disadvantages. If the number of lead wires for each lock device can be reduced, the disadvantages will be eliminated or remarkably improved.

SUMMARY OF THE INVENTION

An object of the present invention is to minimize the number of lead wires required for connection between an electro-mechanical lock device and a control device therefor.

Another object of the present invention is to provide an improved electro-mechanical lock device.

A further object of the present invention is to provide an improved control device.

Other objects and features of the present invention will become apparent from the description of preferred embodiments with reference to the attached drawings.

DETAILED DESCRIPTION OF THE EMBODIMENTS

Figure 1:
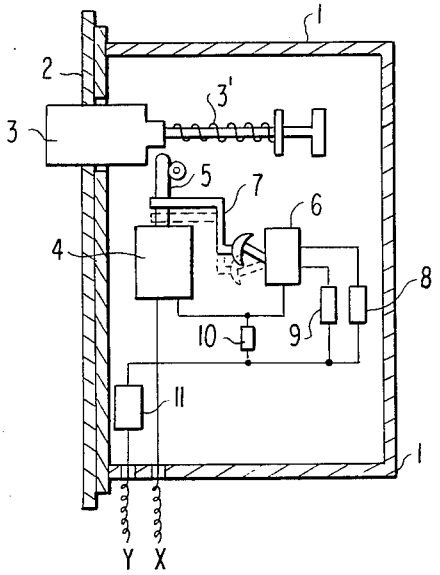
FIG. 1 is a schematic illustration of an electro-mechanical lock device of the present invention.

FIG. 1 shows schematically a lock device according to the present invention. The lock device comprises a mechanical lock mechanism and an electric driving circuit. The mechanical lock mechanism includes a casing 1, a latch seat 2 which is mounted on a door or an associated stud, a latch 3, a latch biasing spring 3', a movable core element 5 and a connecting rod 7. The driving circuit includes a self-sustaining solenoid 4 associated with the movable core element 5, a single pole-double throw snap switch 6 linked via connecting rod 7 to movable element 5, diodes 8 and 9, a resistor 10 and a switch 11 to be opened and closed upon opening and closing of the door.

Figure 2:
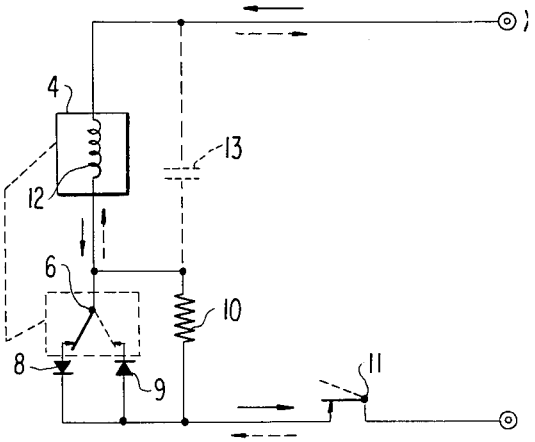
FIG. 2 is a circuit diagram incorporated in the electro-mechanical lock device in FIG. 1.

As illustrated schematically in FIG. 2, the self sustaining solenoid 4, which is composed of a magnetizing coil 12, holds the movable core element 5 in an upper or a lower stable position depending upon the direction of electric current flowing through the magnetizing coil 12. A solenoid coil of the self sustaining type is used wherein the core is held in its stable positions thru the aid of permanent magnets and therefore a much smaller coil current is used during holding operations. However a relatively large current is needed to switch the core from either stable position to the opposite stable position. The construction and characteristics of such self-sustaining solenoid devices per se is well known in the art.

When the movable core element 5 is held in the upper stable position as shown by the solid line in FIG. 1, the lateral movement of the latch 3 is blocked and the lock device is in a locked state. When the movable core element 5 is held in the lower stable position as shown by the dotted line in FIG. 1, the latch 3 is permitted to more rightwardly to thereby unlock the lock device. Of course a bolt may be substituted for the latch 3.

Assume now that the mechanical apparatus is in the state shown by the solid lines in FIGS. 1 and 2, i.e., core 5 is in the stable up position, switch 6 is connected to diode 8. Now when a current is applied in the direction of the solid arrow, a major part flows through diode 8 having a low forward resistance. This current thru coil 12 creates an EM force which opposes and overcomes the self-sustaining force holding core 5 in the up direction. Therefore the core 5 moves to the down direction. As core 5 moves down, mechanical arm 7 throws switch arm 6 to connect switch 6 to diode 9. This parallel connection of diode 9 and resistor 10 presents a large impedance to current in the direction of the solid arrow. Thus the current is reduced greatly thereby conserving power as the core remains in the down, or unlocked position. When the current is inverted, the core is moved back to the locked position, and switch 6 is toggled to connect diode 8 back in the circuit. Thus power is also conserved when core 5 is held in the up, or locked, position.

Thus, the lock device in FIG. 1 is designed such that upon the completion of movement of the self-sustaining solenoid core 5, the switch 6 is inverted so that the amount of current flowing through the coil 12 is abruptly reduced by means of the effect of the diode 8 or 9 to thereby eliminate any unnecessary power consumption.

It is advisable to select, as the switch 6, a switch which toggles after core element 5 moves beyond the intermediate position in its stroke. One example of such a switch is an ordinary micro-switch which acts as a snap switch. Since, in general, the magnetic type self-sustaining solenoid may completely invert even when the magnetizing current is cut out after the movable core element passes the intermediate position in its stroke, it is possible to employ a mechanism in which the magnetizing current is cut by itself by incorporating a switch of the latter type ganged with the movable core element 5.

If a mechanism is used where the switch 6 toggles immediately after core element 5 begins to move, there is the possibility that the self-sustaining circuit 4 will not be inverted. In such a case, a capacitor 13 may be inserted in parallel with the magnetizing coil 12 as shown by the dotted lines in FIG. 2. The magnetizing coil 12 may be supplied with electric energy by the charge on capacitor 13 even after the magnetizing current is cut off by the switch 6, so that the self-sustaining solenoid circuit 4 can be inverted completely.

With the use of the capacitor 13, the switch 6 need not be a single pole-double throw type but, instead may comprise a pair of separate switches, each of which may be switched between on and off according to the upper and lower positions of the movable core element 5. In the latter case, the switches need not be ganged mechanically with the movable core element 5 by the connecting rod 7. It may be possible to employ reed switches each of which is switched between on and off according to a magnetic flux derived from a permanent magnet attached to the movable core element 5.

If current is supplied to move the core in the up direction during the time the door is open, the door can not be closed because the latch 3 is held in its extended position. In order to prevent such a situation from occurring, a door switch 11 is provided in the casing 1. The door switch 11 becomes on when the door is closed and off when the door is open.

Because of the presence of switch 11, the self-sustaining solenoid circuit 4 is opened when the door is open and, therefore, the problem of the undesired extension of the latch is resolved.

Figure 3:
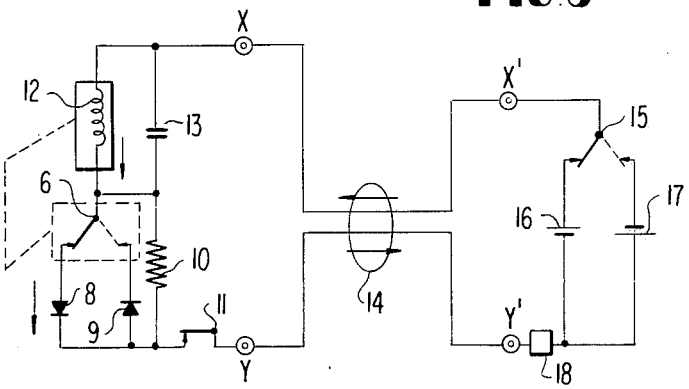
FIG. 3 is a circuit diagram of the present lock system.

FIG. 3 shows the whole system of the present invention wherein the circuitry located with the latch is shown in the left hand portion, the control device is shown in the right hand portion, and the two are connected to each other by a pair of lead wires 14.

The control device includes a driving switch 15, a pair of d.c. power sources 16 and 17 and an ampere-meter 18 which is adapted to detect the direction of current flow and the amount of the current as well as to serve as a monitor for the condition of the lock device.

In operation of the control device in FIG. 3, when the door is closed, the switch 11 is closed so that the current can be supplied from the power sources 16 and 17 through the lead wires 14 to the self-sustaining circuit.

In this state, when the switch 15 is manually turned to the position shown by the solid line, the current flows from the power source 16 through the coil 12 and the diode 8 to thereby unlock the lock device. With the unlocking, the switch 6 is switched to the dotted position and, therefore, the current flows only through the resistor 10, so that the amount of the current is remarkably reduced.

Figure 4:
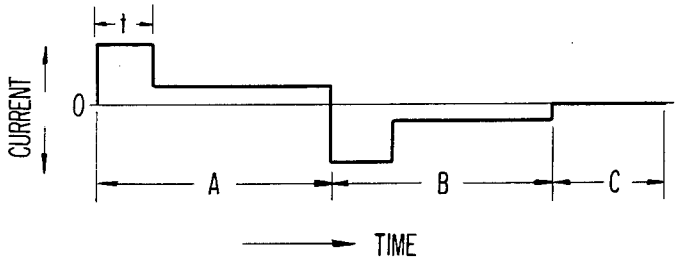
FIG. 4 is a graph showing the current flowing through lead wires connecting the electro-mechanical device and the control device.

FIG. 4 shows the variation of the current flowing through the magnetizing coil 12 with time. In FIG. 4, the time and the current value are shown along X axis and Y axis, respectively.

As shown, in a time period *t* after the power source is connected in the circuit, a relatively large current flows through the magnetizing coil 12 and the value is remarkably reduced at the end of the period *t* which corresponds to the time when the switch 6 is toggled to the other position. The time period *t* is determined by the operation time of the self-sustaining solenoid 4 and is usually about 2 to 30 ms. The above mentioned operation is shown by the period A.

If the ampere-meter 18 indicates that the current value is remarkably reduced at the end of a certain short time period after the operation of the switch 15, it means that the lock device is in the locking state. In this manner, the conditions of the door and the lock device associated therewith can be observed in the control device side.

For unlocking, a relatively large reverse current flows for several tens of milliseconds after the switch 15 is toggled to the dotted position and, thereafter, the value of the reverse current is reduced, which indicates completion of the unlocking operation. This is shown by a period B in FIG. 4. Since the direction of the current is reversed for the locking and unlocking operations, these conditions may be distinguishable in the control device.

Since the current becomes zero when the door is open, it may be also known in the control device side.

Figure 5:
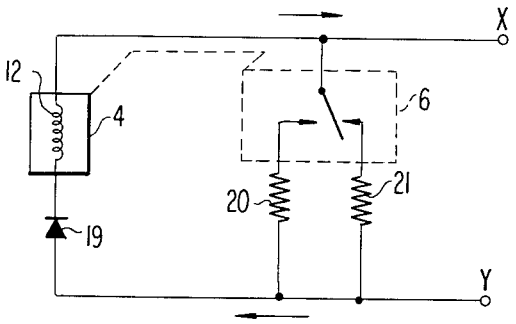
FIG. 5 is another embodiment of the circuit to be incorporated in the electro-mechanical lock device.

FIG. 5 shows another embodiment in which a mechanical sustaining solenoid is used. In FIG. 5, a diode 19 and the coil 12 are connected in series and, a resistor 20 and a resistor 21 are selectively connected by the switch 6, ganged suitably with the coil assembly 12, in parallel with the series circuit. In this embodiment, the locking and unlocking operations are alternately performed by supplying a current to the coil 12 in a single direction. That is, when a current flows through the coil 12 when the device is in the locking state, the state is switched to the unlocking state and vice versa. The time period during which the current continues to flow may be very short. That is, it is enough to supply the current at the instance of starting the locking and unlocking operations, and thereafter, the lock is maintained mechanically in the locking or the unlocking state even if the current is removed. Solenoids of the mech-a-latch type are known in the art and operate in a manner analogous to a single input bistable circuit. That is, a pulse input to the single input terminal switches the device from its present stable state to another stable state. In the case of FIG. 5 the current need only be applied to the circuit in one direction and only for an instant.

The current is supplied in the opposite direction only for measurement purposes. When the values of the resistors 20 and 21 are selected to be higher than the resistance of the coil 12 and a current flows in the direction of the arrow, the lock is locked or unlocked and the switch 6 is also actuated. Therefore the locking or the unlocking operation is performed every time the current is supplied and the locking and the unlocking operations are alternately performed.

For a current in the reverse direction, it can not flow through the coil because of the diode 19. The resistors 20 and 21 are different in value so that there is provided a difference between the currents flowing through the respective resistors 20 and 21 to identify the switch position to thereby indicate whether the lock is in the locking state or the unlocking state.

Figure 6:
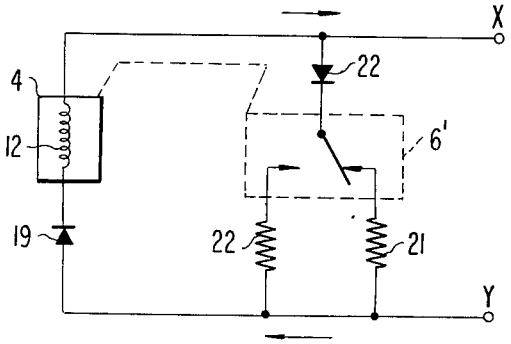
FIG. 6 is another embodiment of the circuit to be incorporated in the electro-mechanical lock device.

FIG. 6 shows a modification of the circuit in FIG. 5. In FIG. 6, a diode 22 is connected in series with the switch 6 and in reverse direction to the diode 19. With this construction, since the current is not shunted to the switch circuit when the coil 12 is actuated, it is possible to reduce the amount of current required to actuate the coil.

Figure 7:
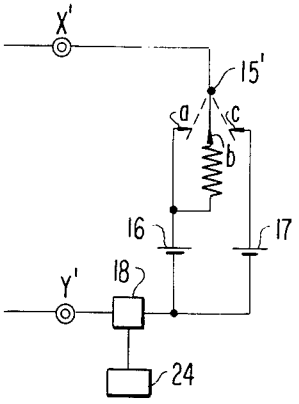
FIG. 7 is another embodiment of the control device.

FIG. 7 is another embodiment of the control device. This embodiment is basically the same as that shown in FIG. 3 except that a switch 15' is employed instead of the switch 15. The switch 15' is a single pole, triple throw switch which has three positions *a, b* and *c.* The switch 15' is positioned normally in the middle position 6 and can be shifted manually to the position *a* or *c.*

Further, a resistor 23 is connected in series with the d.c. power source 16 and an indicator 24 is connected to the ampere-meter 18 for indicating the information from the meter 18.

Describing the operation of the control device in FIG. 7, the switch 11 is closed when the door is closed. In this state, it is assumed that the switch 15' is in the position *b* and the lock device is in the locking state. In this case, the switch 6 is in the position shown by the dotted lines as mentioned previously. Therefore, the current flows from the power source 16, through the resistor 23, the magnetizing coil 12, the resistor 10, the switch 11 and the ampere-meter 18.

The values $R_{10}$ and $R_{23}$ of the resisters 10 and 23 are substantially the same and selected to be much higher than that of the magnetizing coil so that the resistance of the magnetizing coil can be neglected in the locking state. Therefore, the current in the locking state can be represented by $E/(R_{10} + R_{23})$ where E is the voltage of the power source 16.

When it is assumed that the movable core element 5 in the locking state is moved down by the use of a key inserted through the door to change it to the unlocked state, the switch 6 is inverted to the solid position because it is ganged with the movable core element 5. Accordingly, the current flowing through the lead wires becomes $E/R_{23}$ because the resistor 10 is short-circuited by the diode 8.

That is, the condition of the door can be known by measuring the current through the lead wires. For example, if $R_{10}$ is equal to $R_{23}$, the current in the unlocking state becomes twice that in the locking state and it can be easily detected by any well known ampere-meter.

The current, when the door is opened, becomes zero because the switch 11 is opened, and this condition can also be easily detected.

Describing the method for locking the lock device by remote control from the control device, a case where the lock device is in the unlocked condition is firstly considered. In this case, the switch 6 is in the solid position when the switch 15' is manually operated to the position *a,* a sufficient current is supplied from the power source 16 to the driving coil 12 because the resistor 10 is short-circuited by the switch 6 and the resistor 23 is removed from the circuit. Therefore, the self-sustaining solenoid 4 is fully driven to raise the movable core element 5 to thereby lock the lock device. At the same time, the switch 6 is shifted to the dotted position and the resistor 10 is inverted into the circuit. Since the solenoid 4 is held in this state irrespective of the amount of the current, this state can be detected by the ampere-meter 18 by manually shifting the switch 15' to the position *b.*

In this case, however, since a sufficient current flows when the switch 15' is in the position *a,* the signal detected by the ampere-meter 18 is not that which indicates the locked condition and therefore, it is impossible to identify the state of the lock device. The identification of the state of the lock device can only be performed after the switch 15' is returned to the position *b.*

However, since the time required to lock the device may be shorter than about 1/10 seconds, which is determined by the operation time of the solenoid 4, the time during which the switch 15' is maintained in the position *a* is very short and practically negligible. Of course, it is easy by providing a switch ganged with the switch 15' to stop the operation of the detector 18 during the time switch 15' is in a state other than position *b* and to prevent the indicator from providing any erroneous indication.

In order to unlock the lock device by the remote control device, it is sufficient to shift the switch 15' to the position *c.*

By doing so, the power source 16 is removed from the circuit and, instead thereof, the power source 17 supplies a sufficient amount of current through the diode 9 to the magnetizing coil 12 to actuate the self-sustaining solenoid 4 to thereby move the movable core element 5 downwardly, causing the lock device to be unlocked.

At the same time, the switch 6 is inverted to the solid position to thereby cut off the current flowing through the diode 9. Then, when the switch 15' is returned to the position *b,* the unlocked condition is identified by the detector 18.

Figure 8:
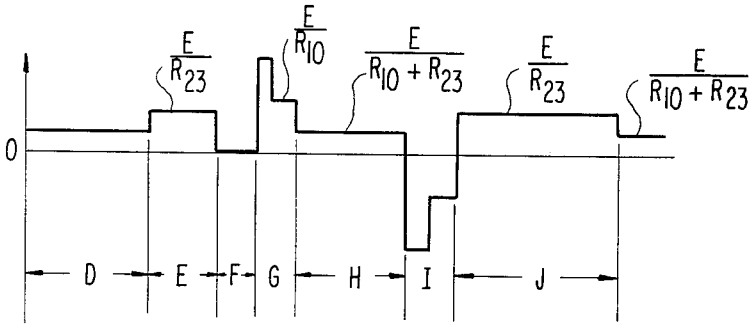
FIG. 8 is a graph showing the current flowing through the lead wires.

The current variation due to the above operation is shown in FIG. 8 wherein periods D, E, F, G, H, I, and J show the locked condition, unlocking by the key, the opening of the door, the locking by the control device, the locked state, the unlocking by the control device and the unlocked condition, respectively. At the end of the period J, the lock device is locked by the key.

Although the power source 16 is also used for the detector in FIG. 7, it is possible to use the power source 17 for the same purpose.

Figure 9:
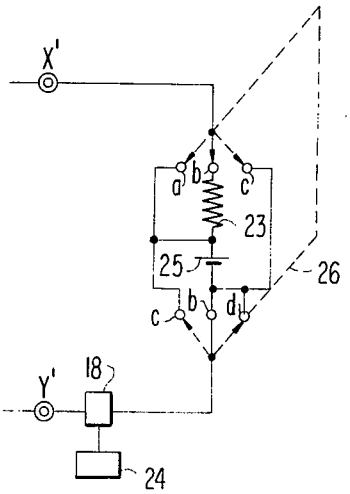
FIG. 9 is a further embodiment of the control device.

FIG. 9 shows another example of the invention, in which a single power source 25 and a switch 26 are substituted for one of the power sources in FIG. 7. The example in FIG. 9 provides the same effect as that obtainable in the example in FIG. 7. The information derived from the detector 18 is transferred to an indication device 24 which may be a visual display or an acoustic device. For example, it is possible to chime the opening of the door in daytime and to ring a bell by night.

According to the present invention, it is possible to remote-control and to monitor the electric lock device with a pair of lead wires by connecting a low impedance power source whose polarity can be arbitrarily selected to the circuit when the electric lock device should be remote-controlled, by connecting a high impedance power source to the circuit when the electric lock device should be monitored and by providing a means for monitoring a current flowing through the circuit.

Therefore, it becomes possible to substantially reduce the costs of wiring and maintenance etc., and this effect is very significant in economy.

What is claimed is:

1. An electro-mechanical lock system comprising, a latch, a pair of supply terminals adapted to be connected to a source of remote power, a self-sustaining solenoid having a coil and a core, said core having two self-sustaining positions locking and unlocking said latch respectively, and said coil being connected to receive power supplied to said pair of supply terminals, impedance changing means connected in circuit with said pair of terminals and said coil for altering the impedance between said pair of terminals when said core moves from one self-sustaining position to another self-sustaining position, a remote control circuit including at least one power source and one measuring device, said remote control circuit being connected to said pair of terminals by a pair of wires.

2. A system as claimed in claim 1 wherein said impedance changing means comprises, first and second diodes having their respective opposite polarity terminals connected to the first of said supply terminals, switch means for selectively connecting the other ends of said diodes to a first end of said coil, the second end of said coil being connected to the second supply terminal, resistor means connected between said first coil terminal and said first supply terminal, and means responsive to the position of said core for causing said switch to connect one of said diodes to said coil when said core moves from a first to a second self-sustaining position and for connecting the other said diode to said coil when said core moves from said second to said first self-sustaining position.

3. A system as claimed in claim 2 wherein said remote circuit comprises remote switch means connected to said at least one power source for selectively applying d.c. current in a first and second direction via said pair of wires to said supply terminals for energizing said coil and switching the self-sustaining position of said core, and wherein said measuring device is an ampere-meter for measuring the current flowing in said pair of wires to thereby indicate the state of said locking system.

4. A system as claimed in claim 1 wherein said solenoid is the type which switches between said two self-sustaining position in response to a pulse of current therethrough in a single direction, a diode connected in series with said coil for permitting current to flow through said coil only in said single direction, and wherein said impedance changing means comprises a pair of resistors having different values from one another, and a switch adapted to connect one of said resistors in parallel with said series connection when said core is in a first self-sustaining position and the other of said resistors in parallel with said series connection when said core is in the second self-sustaining position, and wherein said remote control circuit supplies current in said single direction for a short period to switch said self-sustaining coil and supplies current in the opposite direction for a relatively long period of time to measure the state of said locking system.

5. An electro-mechanical lock system comprising, a latching means, a self-sustaining solenoid having a core and a coil and being adapted to be switched between a first self-sustaining position wherein said core locks said latch and a second self-sustaining position wherein said core does not lock said latch, a pair of supply terminals adapted to be connected to a remote control device, an impedance connected in series with said coil, said series connection connected at opposite ends thereof to said two supply terminals respectively, means, including a pair of oppositely connected diodes and a switch, for selectively connecting said diodes in parallel with said impedance, said last mentioned means being responsive to the position of said core, a pair of wires connected respectively to said two supply terminals, a remote control circuit connected to the other ends of said two wires, said remote control circuit comprising at least one power source and switch means connected thereto to selectively supply voltage of first and second polarity to said two supply terminals, said voltage being sufficient to cause said core to move from either self-sustaining position to the other self-sustaining position, said diodes and said switch being connected in the circuit and responsive to the core position to cause said impedance to be short circuited only for a short period following reversal of the polarity of said voltage, and wherein said remote circuit also includes a measuring means for measuring the current in said pair of wires.

6. The system of claim 5 wherein said remote control circuit comprises first and second power sources, each having opposite polarity terminals connected to one of said pair of wires, and the other terminals thereof selectively connected to the other of said wires via said switch.

* * * * *